US007641555B2

(12) United States Patent
McKinley et al.

(10) Patent No.: US 7,641,555 B2
(45) Date of Patent: Jan. 5, 2010

(54) METHOD AND APPARATUS FOR AUTOMATED CONFIGURATION OF GAMING MACHINE OPERATING PARAMETERS

(75) Inventors: Edward A. McKinley, Chicago, IL (US); Mathew R. Fitzsimons, Lake in the Hills, IL (US); Wayne H. Rothschild, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 763 days.

(21) Appl. No.: 10/794,098

(22) Filed: Mar. 4, 2004

(65) Prior Publication Data

US 2005/0197191 A1 Sep. 8, 2005

(51) Int. Cl.
*A63F 9/24* (2006.01)

(52) U.S. Cl. ..... 463/43; 463/29; 463/40; 463/42; 463/44

(58) Field of Classification Search ..... 463/16–20, 463/25, 29, 40, 42–45
See application file for complete search history.

(56) References Cited

U.S. PATENT DOCUMENTS

| | | | | |
|---|---|---|---|---|
| 5,117,496 | A * | 5/1992 | Stearns et al. | 719/320 |
| 5,655,961 | A * | 8/1997 | Acres et al. | 463/27 |
| 5,954,583 | A | 9/1999 | Green | 463/29 |
| 6,068,552 | A * | 5/2000 | Walker et al. | 463/21 |
| 6,439,996 | B2 | 8/2002 | LeMay et al. | 463/29 |
| 2002/0137217 | A1 | 9/2002 | Rowe | 436/42 |
| 2002/0142846 | A1 | 10/2002 | Paulsen | 463/43 |
| 2002/0188940 | A1 | 12/2002 | Breckner et al. | 717/175 |
| 2003/0069074 | A1 | 4/2003 | Jackson | 463/43 |
| 2003/0153379 | A1 | 8/2003 | Beaulieu | 463/16 |
| 2003/0216182 | A1 * | 11/2003 | Gauselmann | 463/40 |
| 2003/0224858 | A1 * | 12/2003 | Yoseloff et al. | 463/43 |
| 2004/0002379 | A1 | 1/2004 | Parrott et al. | 463/29 |
| 2004/0002383 | A1 | 1/2004 | Lundy et al. | 463/42 |
| 2004/0048668 | A1 * | 3/2004 | Brosnan | 463/42 |

* cited by examiner

*Primary Examiner*—Peter DungBa Vo
*Assistant Examiner*—Jasson H Yoo
(74) *Attorney, Agent, or Firm*—Schwegman, Lundberg & Woessner, P.A.

(57) ABSTRACT

An automated method of configuring a gaming machine using a storage medium such as a paper ticket containing gaming machine configuration parameter data. The storage medium is read by a gaming machine peripheral device, such as a bill validator, which transmits the data to the gaming machine's central processing unit. The central processing unit stores and implements the new configuration parameters. The storage medium is encoded with a machine-readable indicium such as a bar code, a two-dimensional bar code, or any other format including magnetic storage, holograms, etc. An alternate embodiment uses a computer in communication with the gaming machine's central processing unit to download configuration parameters by electronically simulating the gaming machine's pushbutton controls.

9 Claims, 10 Drawing Sheets

METHOD AND APPARATUS FOR AUTOMATED CONFIGURATION OF GAMING MACHINE OPERATING PARAMETERS

FIELD OF THE INVENTION

The present invention relates generally to gaming machines and, more particularly, to a method apparatus for configuring gaming machines such as electromechanical and electronic video gaming machines.

BACKGROUND OF THE INVENTION

Electromechanical and electronic video gaming machines have long been cornerstones of the gaming industry. Because gaming machines are an important source of income for the gaming industry, casinos continually search for new ways to improve gaming machine capabilities, efficiency, and reliability.

Gaming machines, generally display game outcomes as an array of symbols. For each wager, the reels are rotated and stopped to randomly place symbols on the reels in visual association with a display area. Specific symbol combinations and their geometric distribution in the array determine winning outcomes.

There are three main types of gaming machines: mechanical, electromechanical, or electronic. The original slot-type gaming machines were entirely mechanical. Electromechanical gaming machines replaced all-mechanical gaming machines. The electromechanical gaming machines use a microprocessor to determine a random outcome and electrical motors to spin and stop the mechanical reels. The electronic video gaming machine subsequently supplanted the mechanical reels of the electromechanical gaming machine with a video monitor to simulate mechanical reels.

Progress brought electronic video gaming machines into gaming establishments. The advantage of the electronic video gaming machine is that the video display allows game designers to introduce games that could never be practically carried out with an electromechanical gaming machine. As a result, traditional table games such as video poker, keno, and bingo were adopted for use on electronic gaming machines. Today, electronic video gaming machines share the floor with electromechanical slot-type games.

The use of microprocessors significantly advanced the state of the art of gaming machines. The microprocessor gives the gaming machine much greater latitude in determining random game outcomes. Random game outcomes are determined by a random number generator driven by the CPU. A probability table contains all possible game outcomes with each game outcome linked to a number. The random number generated is used to look up the corresponding game outcome in the probability table. The CPU signals the stepper motors to drive and position the reels based on the randomly determined game outcome.

Microprocessor driven gaming machines allow gaming manufacturers to design slot games with more flexible pay tables. With a properly constructed pay table, microprocessor driven gaming machines can offer high value but low probability awards while still offering low value but high probability awards—offering a range of awards that all-mechanical slot machines cannot.

The power of the microprocessor has enabled the introduction of new gaming machine capabilities that allow the addition of entirely new classes of features and functions. These features and functions can be enabled in a variety of different combinations to operate on a wide variety of different technological platforms. In order to enable these features, when gaming machines are first set up, they must be configured to casino specifications. The configuration parameters enable the gaming machine to network with the casino's existing central computer systems to coordinate with the casinos cashless gaming systems, wagering processes, accounting procedures, player tracking data collection, etc.

Gaming machines networked to the gaming establishment's central computer systems must be configured to establish communications. Some configuration parameters involve the selection of communication protocols for communication between the gaming machine and host system that includes: selection of the host ports for electronic funds transfers, establishing gaming machine communication addresses, host communication protocol bonus control, etc.

A number of configuration parameters must also be set to customize the gaming machine for the wagering process used by the gaming establishment. These specifications include: the selection of payout devices (such as hopper or ticket printer, or both), selection of payout options (e.g., split pays from both the hopper and ticket printer), the option of printing a hand pay receipt, and controlling ticket printer parameters.

The gaming machine may also be configured to customize the presentation of the game. These configuration parameters include: gaming machine lighting, speaker volume, presentation of multi-games, payback percentages, etc.

The configuration parameters discussed above are only a few of the configuration) parameters that are potentially available. Some additional miscellaneous configuration categories include: ticket-in control configuration, validation control, validation type, manual ticket time and date entry, ticket common data, and gaming machine operating modes (including demonstration and diagnostic mode). Within each of these categories are a number of different selections, and even sub-selections.

The number and complexity of configuration parameters requires considerable technician time to set up. The configuration process requires selecting and implementing operating parameters for each gaming machine. The gaming machine is manually configured through an extensive set of administration menus. Some parameters require multiple menus and value entries to be completely configured.

The electromechanical gaming machine and the electronic video gaming machine use different methods to set configuration parameters. The electronic video gaming machine has a video display with a touch screen that can be used as an input device to configure the gaming machine. The technician is stepped through the configuration process with instructions and options displayed on the video display for each configuration parameter. The technician selects configuration parameter using the touch screen panel.

In contrast, the configuration of electromechanical gaming machines is particularly problematic. As the mechanical gaming machine does not have a video display, technicians must rely on the information presented in the gaming machine's bet, credit, and win meter display windows (collectively referred to as the meter display). Because the meter display's main function is to convey numeric information during game play, it is not an ideal device for displaying alphanumeric configuration information. The information that can be displayed by the meter display is limited (three-five characters per window) and is generally numerically coded. The technician must either memorize the codes or look up the appropriate codes during the configuration process.

To configure a typical electromechanical gaming machine, technicians must use the meter display windows to scroll through and select specific gaming function codes with push buttons on the gaming machine. Typically, the "Max Bet" button and the "Spin Reels" button on the pushbutton panel, a key switch on the side of the gaming machine cabinet, and the diagnostic button inside the cabinet are typically used to scroll through and select specific gaming function codes as they appear in the meter display. During this process, the gaming machine cabinet door must remain partially open to allow the operator access to the diagnostic button inside the cabinet. The technician must alternate positions—between the inside and the outside of the cabinet—to reach the diagnostic button, view the meter display, and use the pushbuttons. This becomes a time-consuming, tedious, and error-prone process.

Further, if the technician makes a mistake during the configuration process—which is relatively easy to do—the configuration process must start over from the very beginning. This is particularly frustrating as the gaming machine must often be RAM cleared (reset)—a process that generally requires 5 to 10 minutes. This of course is contingent on the technician recognizing that a programming error has been made—there is no hard copy verification that the gaming machine has been configured correctly.

Today both electromechanical and video gaming machines coexist in gaming establishments, each having a significant market share. Electromechanical type gaming machines have a loyal following that trust the mechanical nature of the machine. Electronic video gaming machines attract individuals interested in the game play features and animations that can be presented on a video screen.

Regardless, of the features that can be offered on the electronic video gaming machine, electromechanical gaming machines maintain a significant share of the gaming machine market. Because of the difficulty configuring electromechanical gaming machines, these machines operate at a significant disadvantage to their electronic video counterparts. Overcoming the problems associated with configuring hundreds, if not thousands, of new gaming machines (whether they are electromechanical or electronic gaming machines), is an expensive process. What is needed is a method to automate the configuration process of gaming machines to reduce the time required to set up configuration parameters and increase the accuracy of the configuration process.

SUMMARY OF THE INVENTION

Before they can be placed into service, gaming machines must be configured to the gaming establishment's specifications. Because of the variety of configuration parameters that may be used in the gaming machine and the difficulty of individually programming each gaming machine, the initial configuration process is extremely labor-intensive. Not only is the process labor intensive, it is also error-prone—especially with electromechanical gaming machines and their limited display capability. To improve the configuration process and overall gaming machine maintainability, a methodology has been developed for the automated configuration of both electromechanical and video gaming machines.

This automated configuration process uses an ancillary device commonly found on gaming machines—a bill validator. The bill validator is used to accept wagers in both paper currency and cashless gaming instruments. Cashless gaming instruments are chiefly in the form of paper tickets that are bar coded with a monetary value.

The automated configuration process uses preprinted tickets, similar to the cashless ticket vouchers. The preprinted configuration tickets are encoded with the required configuration parameters. The configuration ticket is read into the gaming machine through the bill validator. The bill validator transmits the configuration parameters to the gaming machine's central processing unit (CPU). The central processing unit in turn identifies the ticket as a configuration ticket and processes the information to configure the gaming machine.

The configuration settings may be verified and a hard copy verification printed once the configuration processes is complete. This verification process uses another commonly installed ancillary gaming machine device—the ticket printer. The ticket printer is normally used to create cashless gaming instruments such as cashless ticket vouchers for use with cashless gaming systems. For the configuration process, the ticket printer may also be programmed to print a verification ticket to confirm the gaming machine's configuration settings.

The gaming machine's configuration settings are printed on the verification ticket, in machine-readable format such as bar code. The verification ticket may also have printed information in alphanumeric readable format. The verification ticket allows the technician to confirm the new configuration parameters and can provide an audit trail to improve security and provide documentation that the configuration parameters have been properly set up.

One advantage of this automated configuration process is that it uses existing peripheral devices ancillary to the operation of many gaming machines. No new equipment is required. This is a significant advantage as a substantial installed base of gaming machines is present in the market that cannot be easily retrofitted to accommodate an automated configuration.

Another advantage of this automated configuration process is that it still allows manual configurations. This is particularly desirable in cases where only a limited number of configuration parameters require modification. It also allows a technician to manually scroll through the settings to verify the configuration of the gaming machine.

Another method for the automated configuration of electromechanical slot machines uses a computer (such as a PDA, personal computer, or laptop computer) to simulate the switch contacts made to manually configure the gaming machine. In some gaming machines, four different sets of contacts (either switches or pushbuttons) are used to manually configure the gaming machine. The computer simulates the signals created by each of the switch contacts. These simulated signals are transmitted in the appropriate sequence to the central processing unit. The CPU uses this data to reconfigure the gaming machine as though the manual configuration process produced the signals.

Additional aspects of the invention will be apparent to those of ordinary skill in the art in view of the detailed description of various embodiments that is made with reference to the drawings, a brief description of which is provided below.

BRIEF DESCRIPTION OF THE DRAWINGS

The foregoing and other advantages of the invention will become apparent upon reading the following detailed description and upon reference to the drawings in which.

Figure 1:
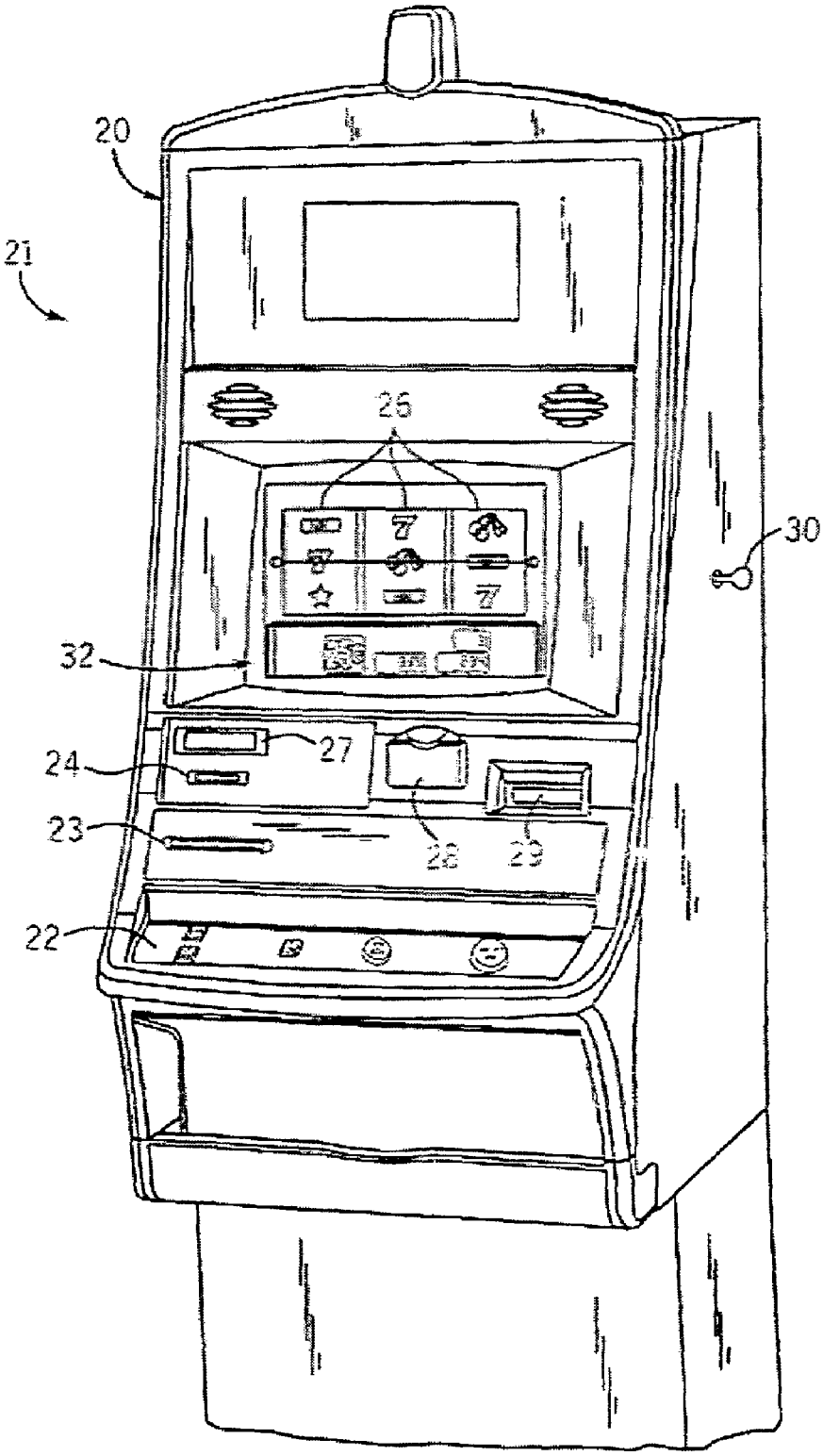
FIG. 1 is a perspective view of an electomechanical gaming machine.

While the invention is susceptible to various modifications and alternative forms, specific embodiments have been shown by way of example in the drawings and will be described in detail herein. It should be understood that the invention is not intended to be limited to the particular forms shown. The invention is to cover all modifications, equivalents, and alternatives falling within the spirit and scope of the invention as defined by the appended claims.

DETAILED DESCRIPTION

The description of the embodiments is to be construed as exemplary only and does not describe every possible embodiment of the invention. Numerous alternative embodiments could be implemented, using either current technology or technology developed after the filing date of this patent, which would still fall within the scope of the claims defining the invention.

Figure 3:
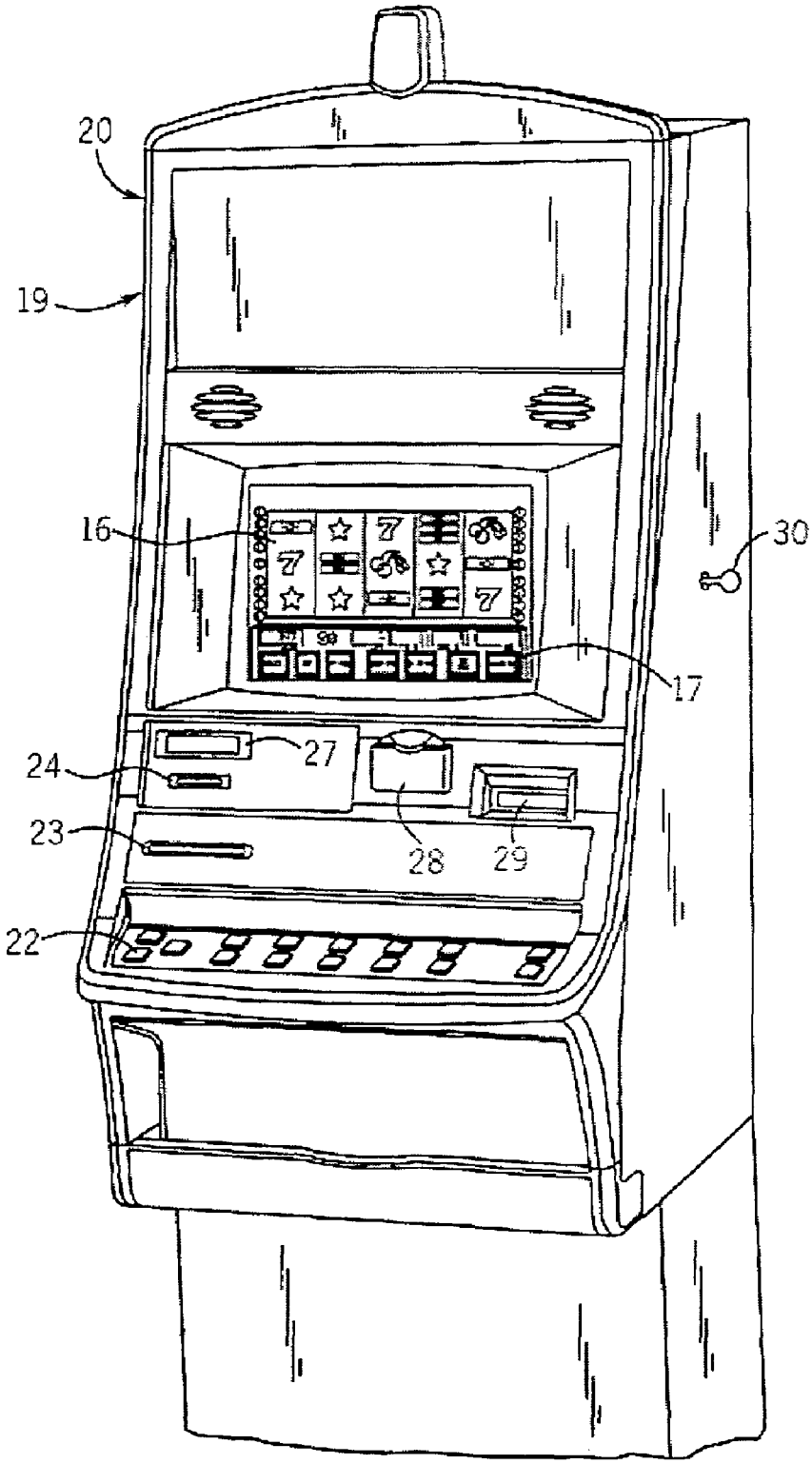
FIG. 3 is a prospective view of an electronic video gaming machine.

Gaming machines 20, such as the ones shown in FIG. 1 and FIG. 3 are typically in serial communication with at least one host computer through a serial poller in a master-slave communication protocol. Each serial poller polls an individual gaming machine for data and the gaming machine 20 replies with the requested data. Each of the host computers gathers information relating to a specific gaming function from the gaming machine 20. Gaming functions may include accounting, player tracking, progressive game controls, and cashless gaming.

When a gaming machine 20 is first installed on the slot floor, both electromechanical 21 and electronic video gaming machines 19 require configuration in order for the gaming machine to communicate with these host computers. In addition to communication parameters, the gaming machine has additional configuration parameters customized according to each casino's preferences. To accomplish this configuration task, both electromechanical 21 and video gaming machines 19 may be configured using an automated process utilizing ancillary peripheral devices commonly found in gaming machines.

To understand the configuration process, the operation of the gaming machine must first be understood. FIG. 1 and FIG. 3 depict a typical gaming machine 20 used by gaming establishments. The gaming machine 20 may be any type of gaming machine and may have varying structures and methods of operation. For example, the gaming machine shown in FIG. 1 is an electromechanical gaming machine 21 with mechanical reels 26. The gaming machine shown in FIG. 3 is a video gaming machine 19 having a video display 16 to present video games such as blackjack, slots, keno, bingo, poker, etc. Typical components found in these gaming machines are described below. It should be understood that many other elements exist and may be used in any number of combinations to create a variety of gaming machine types.

The game is displayed to the player either on a video display 16 in the case of a video gaming machine 19 or on a set of mechanical reels 26 in the case of an electromechanical gaming machine 21. The video display 16 may take the form of a cathode ray tube (CRT), a high resolution LCD, a plasma display, LED, or any other type of video display suitable for use in a gaming machine.

A push button panel 22 is typically offered for both the electromechanical and video type gaming machines to allow players to make various gaming selections. The video gaming machine 19 also typically includes a touch screen 17 over the video display 16 that allows players to also make game selections through the touch screen 17.

Many gaming machines 20 are also equipped with a player tracking card reader 24. A player may be enrolled in the gaming establishment's player club, which may award certain complimentary services/offers commensurate with the points collected by the player. The player's card is inserted into the player tracking card reader 24, which allows the casino's computers to register that player's wagering activity at that gaming machine 20.

A wager acceptor, such as a coin slot acceptor 28 or bill validator 29, may be used to place a wager on the gaming machine 20. The bill validator 29 can accept either paper currency or ticket vouchers. The bill validator 29 reads the currency or the ticket voucher and applies the value read as credits playable on the gaming machine.

Gaming machines 20 also generally have a ticket printer 23 used to print or otherwise encode ticket vouchers with a monetary value. The ticket printer is used in cashless gaming systems and allows a player to receive a ticket voucher instead of currency when a player cashes out of the gaming machine. The ticket voucher contains not only the monetary value of the ticket, but also typically the casino name, validation number, bar code with control and/or security data, date and time of issuance of the ticket voucher, redemption instructions and restrictions, etc. The ticket voucher may be redeemed at a cashier.

Alternately, the player may insert the ticket voucher into the bill validator 29 of any cashless equipped gaming machine 20. If inserted into a bill validator 29 of a gaming machine 20, the gaming machine reads the bar code on the ticket voucher and transfers the monetary value encoded on the ticket to the gaming machine. For security purposes, the ticket voucher is retained inside the gaming machine.

Figure 2:
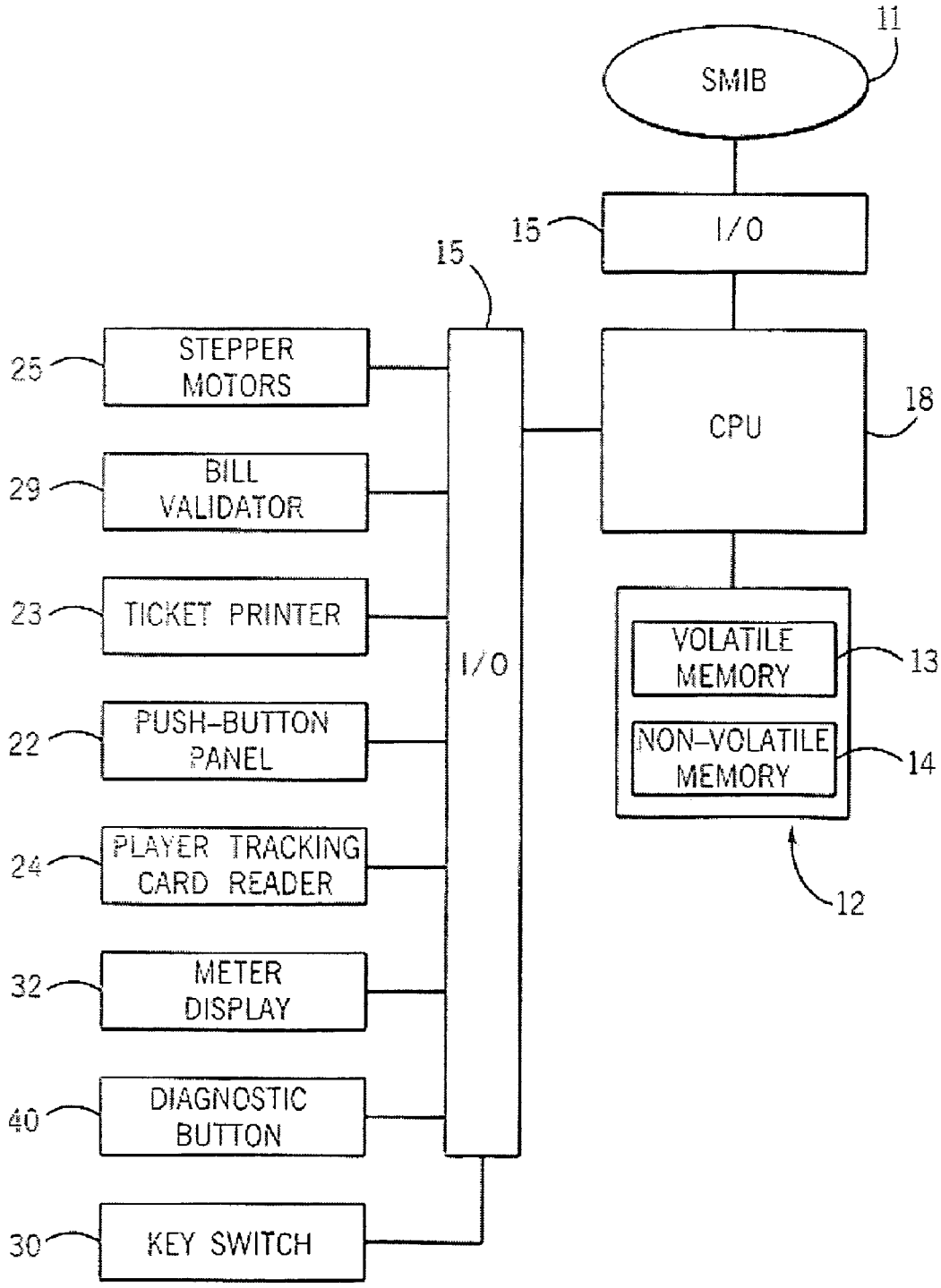
FIG. 2 is a block diagram of the electronic components typically used in the electromechanical gaming machine of FIG. 1.
Figure 4:
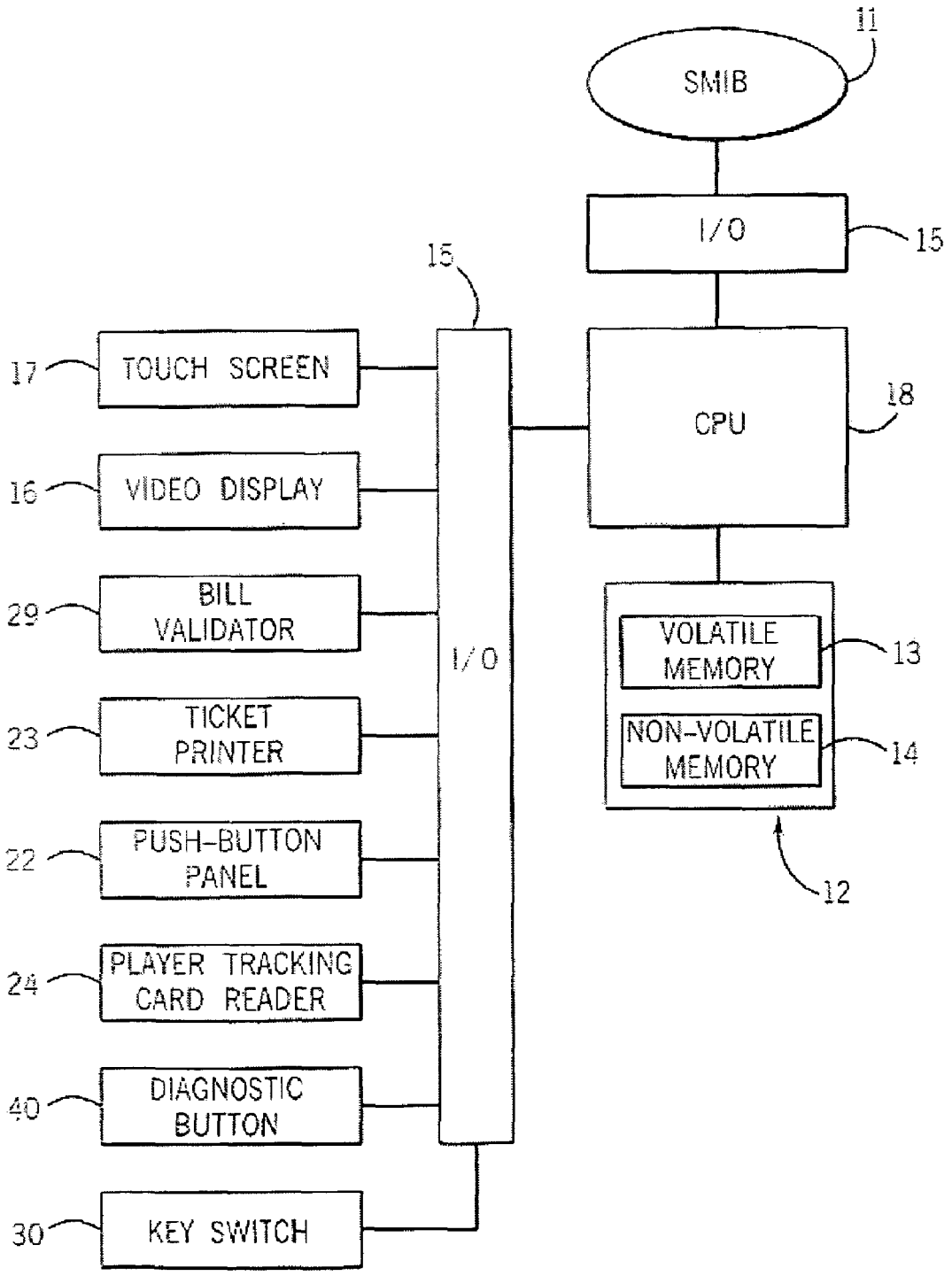
FIG. 4 is a block diagram of the electronic components typically used in the electronic gaming machine of FIG. 3.
Figure 5:
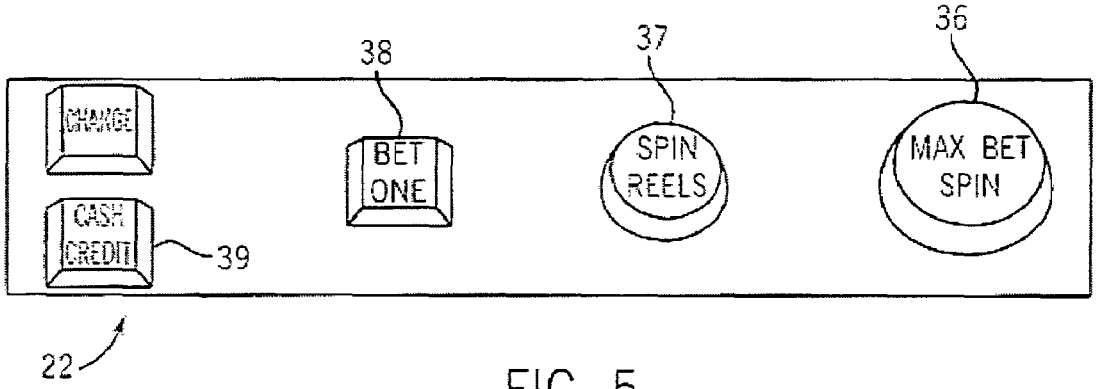
FIG. 5 is a typical pushbutton panel for the electromechanical gaming machine shown in FIG. 1.
Figure 6:
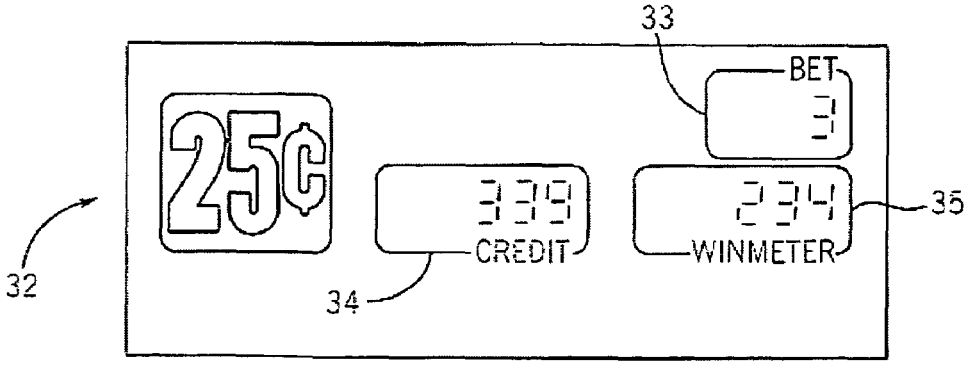
FIG. 6 depicts the meter displays typically found in an electromechanical gaming machine of FIG. 1.

The push button panel 22, a player tracking card reader 27, stepper motors, bill validator 29, ticket printer 23, coin acceptor 28, and various other components of a gaming machine are controlled by a central processing unit (CPU) 18 (such as a microprocessor or microcontroller) as shown in FIG. 2 and FIG. 4. FIG. 2 and FIG. 4 show only a few of the peripheral devices that are controlled by the CPU 18. In addition to controlling peripheral devices, the central processing unit 18 operates to execute a game program.

The game program is stored in the memory of the CPU 18. The CPU 18 may comprise a volatile memory 13 (e.g., a random-access memory (RAM)), a static memory 14 (such as an EEPROM), and an input/output (I/O) circuit 15. It should be appreciated that although only one microprocessor is shown, the CPU 18 may include multiple microprocessors.

Similarly, the memory of the CPU 18 may include multiple RAM and multiple program memories. Although the I/O circuit 15 may be shown as a single block, it should be appreciated that the I/O circuit may include a number of different types of I/O circuits. This communication link allows the bill validator 29 to be used with the CPU 18 to effect the needed configuration parameters.

Figure 7:
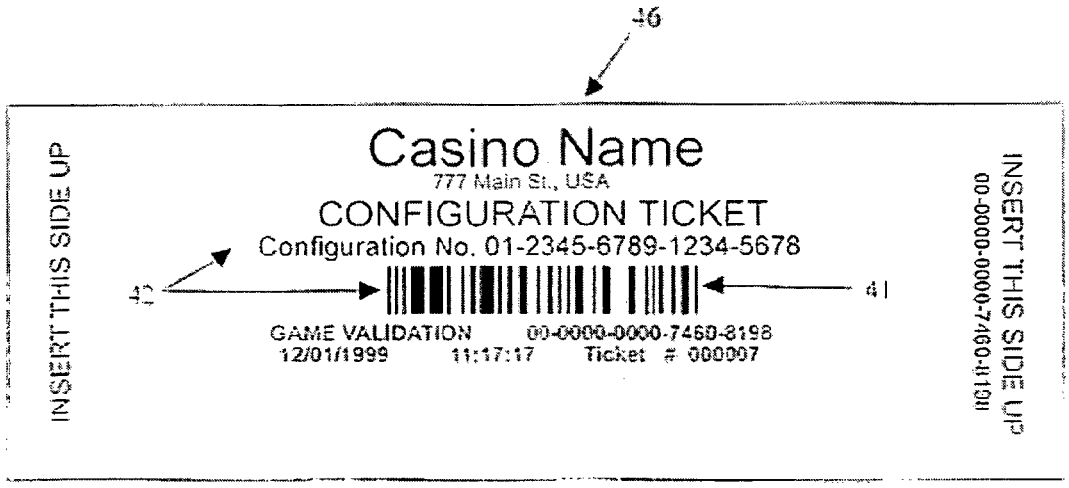
FIG. 7 is a configuration ticket with encoded data specifying a specific configuration type.

The bill validator 29 and the CPU 18 (of either an electromechanical or an electronic video gaming machine) may be programmed to read and accept information from a ticket containing configuration parameters. A bar code 41 is printed in a specific area on the configuration ticket 46 that is readable with a standard bill validator. A typical cashless ticket voucher uses the bar code as a 'validation number' for the cashout ticket. The bar code 41 can contain a maximum of 18 numeric digits. A configuration ticket 46 may be created using this bar code to represent configuration parameters rather than a validation number. A configuration ticket 46 with typical configuration data is shown in FIG. 7.

The bar code 41 on the configuration ticket has a predetermined data format used to transfer configuration information to the gaming machine. In addition, to bar coding 41, the configuration ticket 46 may also contain alphanumeric printed information. The printed information may relate to the type of configuration data and the parameter values that the ticket is configuring. The configuration ticket 46 may also identify the gaming machines that the ticket is intended to configure.

The configuration ticket 46 can be fed into the bill validator 29 in the same way as a cashless ticket voucher. The bill validator 29 reads the configuration ticket 46 and transmits the information to the game machine's CPU 18. The CPU 18 recognizes the configuration ticket 46 by specific identifying indicia on the ticket. Another method of signaling the gaming machine to expect a configuration ticket is to place the machine in its configuration mode. In response to the ticket, software in the CPU 18 automatically configures the gaming machine 20 with the configuration parameters on the configuration ticket 46.

There are a number of ways to use the bar coded number to configure the gaming machine. One is the 'database' approach. Every possible combination of gaming machine parameters is listed in a database and assigned a numeric value that references a specific combination of parameters. The database is stored in the gaming machine memory 12. The number encoded on the configuration ticket 46, as shown in FIG. 7, corresponds to a database record 42 and identifies the configuration parameters selected for the gaming machine 20.

Another approach is to categorize each of the gaming machine's configuration parameters. The first one or two digits of the ticket can be used as a "category index." The digits following the category index can be used to identify a database record (similar to the first scheme, but with potentially a multiplicity of smaller databases) or as configuration values directly. For example, sound volume configuration settings have a number of possible values. Sound volume configuration parameters consist of a volume setting for both the left and right sound channels. The volume setting has a range from 0-100, and each channel (left and right) can be set to different values. The 18-digit bar code numeric value could be '0100000000LLL00RRR', where '01' is the index for sound configuration, and 'LLL/RRR' are the numeric values of the volume setting for left and right channels.

Figure 8:
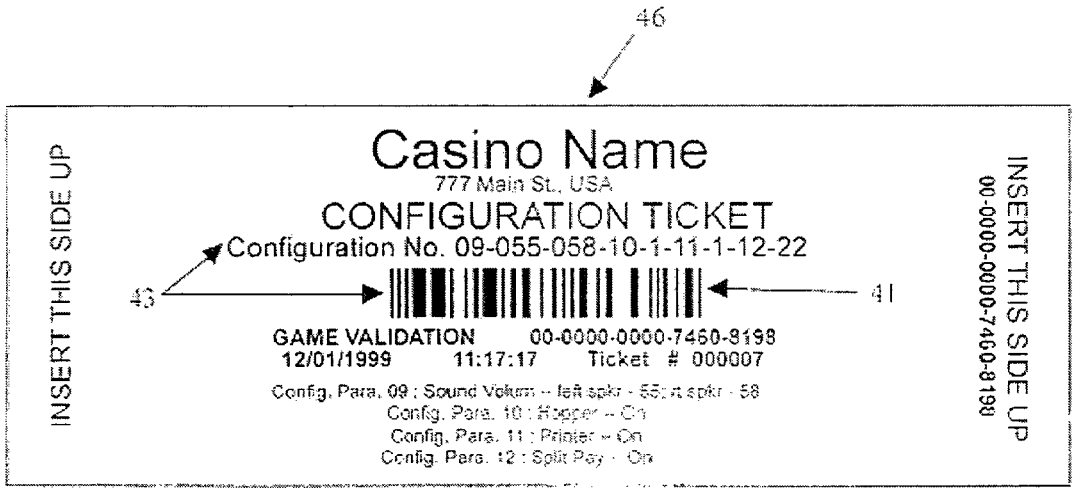
FIG. 8 is a typical configuration ticket with encoded data specifying configuration parameters for multiple configuration selections.

It is also possible to use a similar approach as described above except providing a number of different configuration categories on a single ticket to increase information density. This is shown in FIG. 8. In this embodiment, the CPU 18 may be programmed to recognize the first two digits in the field as a category index. Once the category is identified, the CPU 18 is further programmed to read a predetermined number of digits in the field that follows. These digits specify the value of the configuration parameter. The CPU 18 then identifies the next category index based on the position of the previous category index and the number of digits assigned to that configuration parameter. Utilizing this technique, a string of numeric configuration category indices with their associated configuration values can be imprinted on the ticket as a bar code 41 as shown in FIG. 8. The bar code 41 corresponds to a configuration selection 43 and identifies the configuration parameters selected for the gaming machine 20. The bar coded number can be parsed to identify and correlate with specific configuration parameters and their values.

Even with this technique, because of the limited data that can be stored on a bar coded ticket, several configuration tickets may be required to completely configure a typical gaming machine. If more than one configuration ticket is required, identifying indicia can be placed on each ticket voucher to show the sequence of the ticket voucher and the number of ticket vouchers in the sequence.

In either of the two cases described above, configuration tickets can be selectively printed to configure a limited number of specific configuration parameters. This is particularly useful once the gaming machine has been installed and requires only minor modifications. This also allows gaming machine configuration using both manual and automated techniques. For example, the technician may manually configure certain parameters and complete the configuration process with preprinted configuration tickets.

For security purposes, the gaming machine may only accept configuration tickets 46 when in the configuration mode. A technician may only access the configuration mode with both a key to unlock the gaming machine 20 and appropriate identification, usually a magnetic identification card. The ID card is read by the gaming machine, which transmits the identification data to a central system host server. The host server gives the technician with the appropriate identification clearance to configure the gaming machine. For additional security, if a configuration ticket 46 is inserted into the gaming machine 20 during normal play mode, the bill validator 29 traps the configuration ticket within the gaming machine and generates an appropriate log entry for security.

There are a number of methods to create configuration tickets 46. For example, the technician may first manually configure the gaming machine. Once the first gaming machine 20 has been successfully configured, the technician orders the gaming machine to print out a configuration ticket 46 from the ticket dispenser 23. This configuration ticket 46 contains the gaming machine's 20 configuration parameters as programmed by the technician. This allows the technician to set up one game in a bank, print a configuration ticket for that game, and then configure the remainder of the bank using the same configuration ticket.

Alternatively, the configuration ticket 46 may be produced using standard personal computers and a ticket printer 23. This embodiment allows the personal computer to run specialized software for producing configuration tickets. A technician may use the computer's video display and mouse to make the needed configuration selections. Once all of the needed configuration selections have been selected, the computer can signal the ticket printer 23 to print the configuration ticket 46 with the appropriate bar code and other identifying indicia. Configuration tickets can be printed on materials other than the paper typically used by gaming machines. For example, configuration tickets can be printed on plastic materials that have much greater physical strength and durability than the ticket paper commonly used in cashless gaming systems.

After the gaming machine 20 has been configured, a hard copy verification of the installed configuration parameters can be issued from the ticket printer. At the end of the configuration process, the CPU 18 verifies that the configuration parameters have been correctly set up in the gaming machine. If the configuration has been set up correctly, the CPU sends a verification message to the ticket printer 29 and, in turn, prints a verification ticket 44 shown in FIG. 9.

Figure 9:
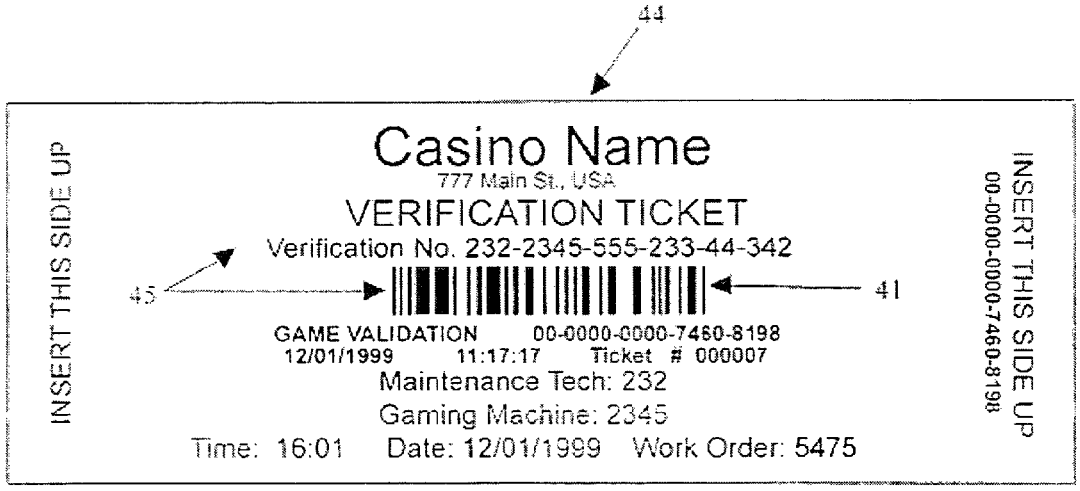
FIG. 9 is a typical verification ticket verifying that the required configuration parameters have been successfully set up in a gaming machine.
Figure 10:
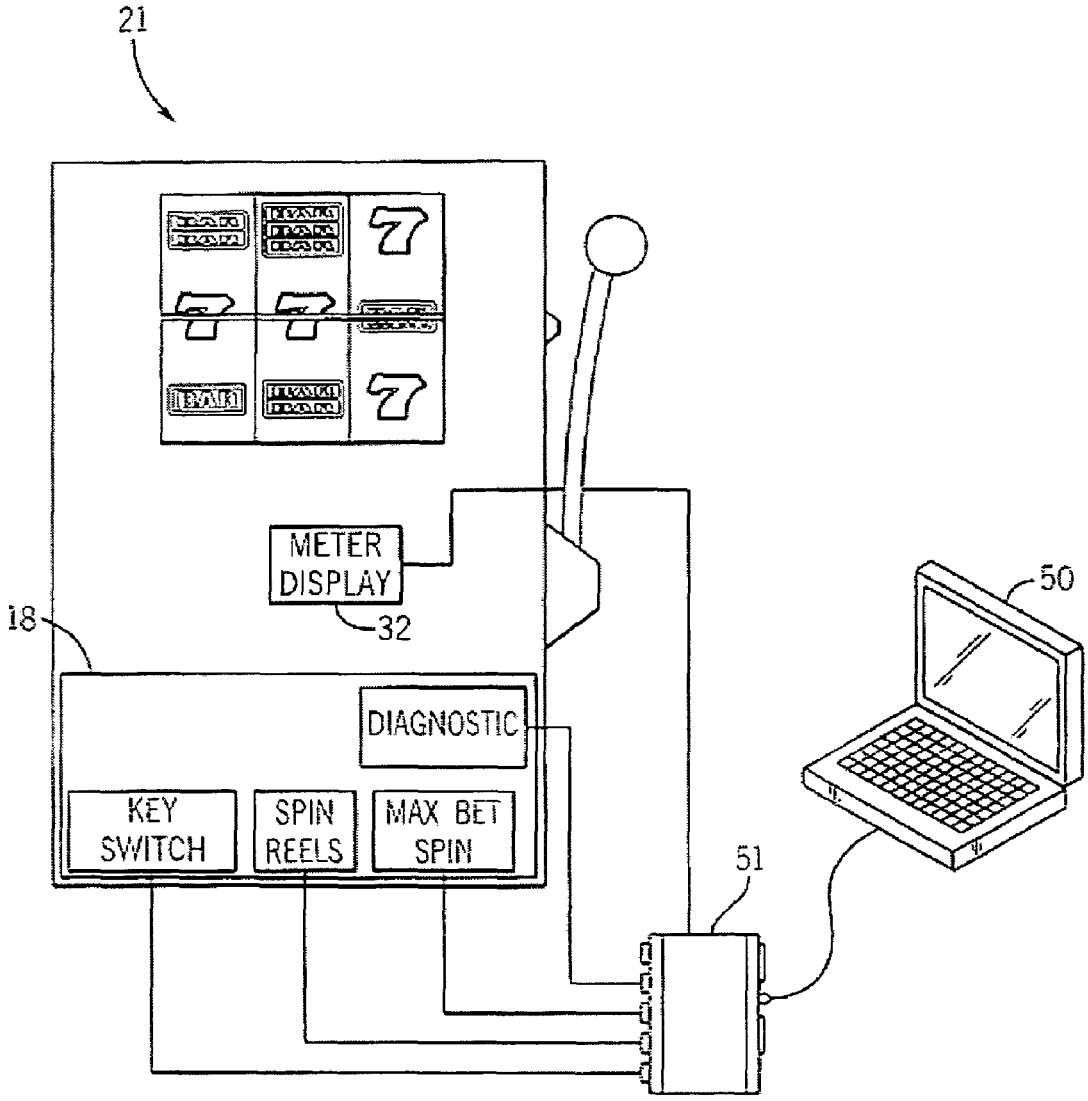
FIG. 10 is a method for configuring an electromechanical gaming machine using a computer.
Figure 11:
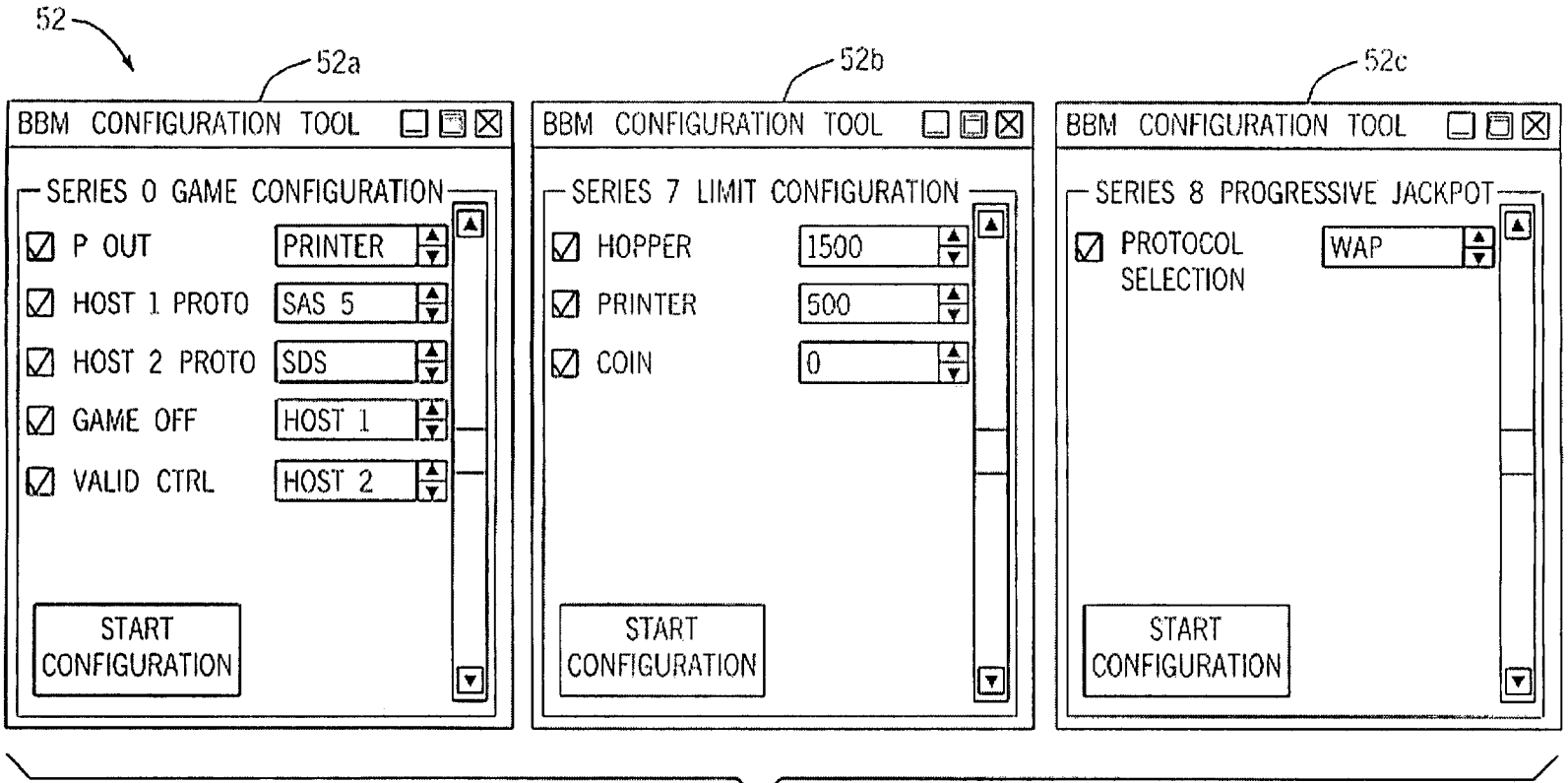
FIG. 11 is a typical screen shot of computer display screens used to assist in the selection of configuration parameters for a gaming machine.

The verification ticket 44 contains verification information 45 in the form of a bar code or alphanumeric printed information as shown in FIG. 9. This verification ticket may include the gaming machine's ID, the time and date of configuration, the configuration parameters installed, the configuration parameters changed, identity of the technician who made the changes, work order number, etc. This verification ticket provides an audit trail for the gaming establishment to confirm that the configuration parameters have been set up in a specific gaming machine.

Although the concepts discussed above focus on changing the configuration parameters of the gaming machine, in many jurisdictions only certain configuration parameters might be acceptable. Consequently, the gaming machine may be designed to verify that the configuration parameters requested are allowable in the jurisdiction. If they are not allowable, the configuration ticket is rejected without changing the gaming machine configuration parameters. If a verification ticket is printed, it will indicate that the configuration ticket has not been accepted and the configuration parameters have not been changed. In addition to jurisdictional reasons other reasons makes its for denying the requested configuration parameter change. The acceptable configuration parameters may be installed as part of the configuration database.

To ensure the security of the configuration tickets and to minimize the possibility of fraudulently reconfiguring the gaming machine, the configuration parameters represented by the barcode indicia may be encrypted to help keep the configuration process secret. This hinders the counterfeiting of configuration tickets. Security can be further enhanced by using and encrypting validation numbers.

As noted above, either electromechanical 21 or video gaming machines 19 may use this configuration methodology to improve the efficiency and accuracy of gaming machine 20 configurations. Although emphasis has been placed on using this configuration methodology in association with electromechanical gaming machines 21, video gaming machines 19 can also be configured using the same technique.

Although the above description references the use of bar coded information readable by the bill validator, configuration tickets may use other methodologies for storing optically readable data sets. For example, in addition to standard bar coding, information may be encoded utilizing a two-dimensional bar code, mark sense tickets, etc.

A data storage medium other than optically scanned materials may be used with the present invention. The present invention may also be used in other cashless gaming technologies, utilizing smart cards and other electronic media to store monetary value. For example, a smart card in a cashless gaming system may be used to store configuration parameters to automatically configure the gaming machine in a similar manner as described above for the printed configuration ticket. Only the medium on which the configuration data has been stored has changed. Consequently, the technician, rather than having a printed configuration ticket, may carry a smart card with the appropriate configuration parameters encoded in electronic storage. The smart card, rather than being read by a bill validator, is read by a smart card reader.

Furthermore, any peripheral device with data reading capability may be used in combination with an appropriate data storage medium to transmit configuration data to the central processing unit 18. For example, the player tracking card reader may be used to read configuration data.

Another method for configuring the operating parameters of an electromechanical gaming machine is to mimic the manual operation of the pushbuttons and switches with a computer 50. The computer 50 is connected to the electromechanical gaming machine 21 to simulate the electronic signals made with the manual pressing of the gaming machines buttons—the "Spin Reels" 37 and the "Max Bet" 36 pushbutton panel buttons, the diagnostic button 40 (internal to the gaming machine), and the key switch 30—used to configure many electromechanical gaming machines.

Depending upon the type of gaming machine, other switches and pushbuttons may be used, and the exact number and functionality of these signal producing devices is irrelevant to the application of this invention. For ease of reference, the pushbuttons, switches, and any other signaling mechanism will be referenced commonly as switches—regardless of their functional implementation, all transmit an electrical signal.

The actuation of any of these pushbuttons or switches produces an electrical signal that is transmitted to the gaming machine's CPU 18. These signals cause the gaming machine to scroll through a configuration parameter menu and to select a configuration parameter. The selected configuration parameter may be implemented in the gaming machine using another manual switch actuation. If a second configuration parameter is needed, a second set of manual switch actuations is made to select and implement the second configuration parameter. The manual switch actuations needed to select a configuration parameter is based on the last selected configuration parameter in the configuration parameter menu.

The computer 50 may be any electronic device having memory to store configuration parameters and some computational ability to communicate configuration signals to the gaming machine to simulate electrical signals produced with manual switch actuation. For example, the computer 50 may be a PDA, laptop computer, a personal computer, etc.

The computer 50 is connected to the gaming machine's CPU 18 by disconnecting the wiring harness connectors used for each switch. The computer 50 is connected to the CPU 18 through the gaming machine's backplane. It is possible to incorporate a junction box 51—acting as a switch relay control circuit—to connect the computer 50 to the CPU 18 to simplify the electrical connection of the computer to the gaming machine. This junction box 51 ties into the CPU 18 on one side, and on the other side, connects to computer 50. This allows simulated switch signals sent from the computer 50 to reach the CPU 18 as though they were sent from the four switches. The computer 50 can be connected to the backplane of the gaming machine 21 using any communication interface, including serial, parallel, USB, FireWire, Ethernet, WIFI, Bluetooth etc.

The configuration processes initiated with the user selecting and verifying that the proper configuration parameters have been programmed into the computer 50. Next, the gaming machine 21 is checked to verify that it is in the initial configuration starting state to accept the predetermined configuration signal sequence. If the gaming machine 21 is not in the correct initial configuration starting state, the configuration program—which assumes a predetermined starting state to set the sequence of configuration signals required—will not correctly configure the gaming machine. The starting state is the gaming machine's position in the configuration parameter scroll menu. The initial configuration starting state is a predetermined position in the configuration menu from which the computer 50 determines the appropriate manual switch actuations necessary to select a required configuration parameter.

To ready the gaming machine 20 to accept the configuration parameters, the initial configuration starting state is queued up by initially clearing the gaming machines RAM memory and manually sequencing through the configuration menu until the appropriate starting state is displayed on the meter display 32. Once the initial starting state of the meter display 32 is confirmed, the technician begins downloading the needed configuration parameters based on equivalent switch actuations simulated by the computer 50. Through this coordinated switch control, the computer 50 will, in effect, simulate the cycling of the switches used in selecting and setting configuration data for the gaming machine.

One advantage of this embodiment is that the gaming machine 21 does not require any significant modification: hardware or software. The external computer 50 simply mimics the physical actions of a human operator in electronic form.

In another embodiment, the meter display 32 is monitored with the computer 50 to eliminate the need to manually sequence the meter display to the initial configuration starting state. The computer 50, recognizing the current meter display 32, can simulate the actuation of the appropriate switches to bring the meter display 32 into the initial configuration starting state.

The previous embodiment can be taken one step further, and recognizing the current meter display 32, can determine the necessary signals, on the fly, to automatically provide the appropriate signals to immediately launch the configuration process, without first reverting to an initial configuration starting state.

At the end the configuration process, a verification process may be initiated to verify that the gaming machine has been configured correctly. One method for doing this is to continuously monitor the meter display 32 to ensure the CPU 18 correctly responds to each of the configuration signals provided by the computer 50. This is possible since the CPU 18 continuously updates the meter display 32 as the gaming machine switches are activated. Likewise, the computer's 50 simulation of these switch actuations also causes the CPU 18 to immediately update the meter display 32. The computer 50 can monitor the meter display 32 via a cable connection through the junction box 51 to verify that the meter display signals monitored by computer 50 correspond to the signals sent from the computer 50 to the CPU 18.

An electronic video gaming machine can be similarly configured. The configuration of an electronic video gaming machine may be automated by simulating the manual entry of data through the video display touch screen using a computer 50 to send the appropriate electronic signals (serial commands) to the gaming machine's CPU 18. Knowing the initial configuration starting state, the computer can download to the CPU 18 the electrical signals corresponding to the manual inputs required to set up the selected configuration parameters. The computer 50 sends the identical electrical signals that a human touching the touch screen would create during manual configuration The computer 50 must first be placed in communication with the gaming machine 20. The gaming machine's internal touch screen controller is temporarily disconnected and the computer 50 is connected to the gaming machine's CPU 18 through the gaming machine's backplane. The electrical signals may be downloaded through a junction box 51, which connects the gaming machine CPU 18 to the computer 50.

The electronic video gaming machine is prepared to receive signals from the computer 50 by first manually switching the gaming machine into configuration mode. A specific configuration screen is manually selected that is the predetermined initial configuration starting state. Once the initial configuration starting state is displayed, the computer 58 may begin to download the electrical signals necessary to configure the gaming machine 20.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of configuring a gaming machine from a computer, the method comprising:

accessing a sequence of manual touch screen actuations at the computer, which when used on a video display implement a configuration parameter for the gaming machine, the configuration parameter stored on the computer;

establishing a communication link between the computer and a central processing unit in the gaming machine;

transmitting a first actuation signal from the computer to the gaming machine, the first actuation signal being identical to a signal produced by a first manual touch screen actuation selected from the sequence of manual touch screen actuations;

determining whether the central processing unit correctly responds to the first actuation signal; and in response determining that the central processing unit has correctly responded to the first signal, transmitting a second actuation signal from the computer to the gaming machine, the second actuation signal being identical to a signal produced by a second manual touch screen actuation selected from the sequence of manual touch screen actuations, the second manual touch screen actuation being subsequent to the first manual touch screen actuation, wherein the sequence of manual touch screen actuations cause the gaming machine to select the configuration parameter from a configuration parameter menu.

2. The method of configuring a gaming machine as described in claim 1, further including manually resetting the gaming machine to a predetermined initial starting state prior to transmitting the first actuation signal.

3. The method of configuring a gaming machine as described in claim 2, wherein resetting the gaming machine to the predetermined initial starting state includes clearing a random-access memory (RAM) of the gaming machine.

4. The method of configuring a gaming machine as described in claim 2, wherein resetting the gaming machine to the predetermined initial starting state includes manually selecting a specific configuration screen on the video display.

5. The method of configuring a gaming machine as described in claim 1, wherein the sequence of manual touch screen actuations needed to implement the required configuration parameter is determined by monitoring the video display.

6. The method of configuring a gaming machine as described in claim 1, wherein establishing the communication link between the computer and the central processing unit in the gaming machine includes establishing the connection via a junction box in the gaming machine, the junction box acting as a switch relay control circuit such that when the communication link between the computer and the central processing unit is active, communication from the touch screen controller to the central processing unit is disabled.

7. The method of configuring a gaming machine as described in claim 1, wherein establishing the communication link between the computer and the central processing unit in the gaming machine includes:

disabling a touch screen controller associated with the video display so that the touch screen controller cannot communicate with the central processing unit;

providing a physical connection by connecting the computer to the gaming machine using a backplane of the gaming machine; and establishing the communication link using the physical connection.

8. The method of configuring a gaming machine as described in claim 1, wherein determining whether the central processing unit correctly responds to the first actuation signal includes:

continuously monitoring a display associated with the gaming machine.

9. The method of configuring a gaming machine as described in claim 8, wherein the display is a meter display.

* * * * *

UNITED STATES PATENT AND TRADEMARK OFFICE

CERTIFICATE OF CORRECTION

PATENT NO. : 7,641,555 B2
APPLICATION NO. : 10/794098
DATED : January 5, 2010
INVENTOR(S) : Ed A. McKinley et al.

It is certified that error appears in the above-identified patent and that said Letters Patent is hereby corrected as shown below:

In column 2, line 29, delete "configuration) parameters" and insert -- configuration parameters --, therefor.

In column 4, line 63, delete "electomechanical" and insert -- electromechanical --, therefor.

In column 11, line 64, delete "configuration" and insert -- configuration. --, therefor.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,641,555 B2
APPLICATION NO. : 10/794098
DATED : January 5, 2010
INVENTOR(S) : McKinley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1239 days.

Signed and Sealed this

Twenty-first Day of December, 2010

David J. Kappos

David J. Kappos
*Director of the United States Patent and Trademark Office*